US008371994B2

(12) United States Patent
Kruglov

(10) Patent No.: US 8,371,994 B2
(45) Date of Patent: Feb. 12, 2013

(54) ADJUSTABLE SPRING DEVICE FOR WALKING AND RUNNING

(76) Inventor: Sergey V. Kruglov, Verdun (CA)

( * ) Notice: Subject to any disclaimer, the term of this patent is extended or adjusted under 35 U.S.C. 154(b) by 0 days.

(21) Appl. No.: 13/374,028

(22) Filed: Dec. 8, 2011

(65) Prior Publication Data

US 2012/0115687 A1 May 10, 2012

Related U.S. Application Data

(63) Continuation-in-part of application No. 12/925,127, filed on Oct. 15, 2010, now abandoned.

(51) Int. Cl.
*A63B 21/00* (2006.01)

(52) U.S. Cl. ..... 482/79; 482/80

(58) Field of Classification Search ..... 482/44, 482/49, 79, 80, 10, 11, 74, 76
See application file for complete search history.

(56) References Cited

U.S. PATENT DOCUMENTS 5,722,919 A * 3/1998 Timmer ..... 482/79
6,589,141 B1 * 7/2003 Flaggs ..... 482/79
6,740,011 B1 * 5/2004 Tsai et al. ..... 482/80

* cited by examiner

*Primary Examiner* — Jerome w Donnelly
(74) *Attorney, Agent, or Firm* — Aleksandr Smushkovich

(57) ABSTRACT

An adjustable spring device for walking and running is attached to user's footwear creating comfortable conditions during the locomotion. In an embodiment, it includes: an upper lever and lower lever locating one above the other, wherein at least one of the levers is made of elastic material, and a support mechanism having a joint shaft that allows the levers to be pivoting. The device includes a first flexible link connecting the front ends of the levers, and a second flexible link connecting the rear ends of the levers. The links can be adjusted to a certain constant length before the deployment of the device. For creating optimal energy exchange conditions between the device and user, and reducing the shock loads on the user's leg joints and spine, the device can be adapted by shifting the support mechanism between the levers and by adjusting the flexible links between the lever ends.

10 Claims, 8 Drawing Sheets

ADJUSTABLE SPRING DEVICE FOR WALKING AND RUNNING

CROSS-REFERENCE TO RELATED APPLICATIONS

This application is a continuation-in-part application of a nonprovisional application Ser. No. 12/925,127 filed on 15 Oct. 2010 now abandoned, whose disclosure is incorporated herein by reference. The nonprovisional application Ser. No. 12/925,127 is hereby expressly abandoned.

FIELD OF THE INVENTION

The invention relates to devices intended to supplement footwear and facilitate walking and running of users of the footwear. The inventive adjustable spring device for walking and running is attached to the footwear and provides the user with a spring action during his/her movement on the ground. The inventive device encompasses an elastic system that absorbs, stores, and returns the kinetic energy during the gait cycle. The device can be adjusted for specific user needs according to the user's bodymass and a unique manner of locomotion of the particular user. The invention can be utilized for exercising, rehabilitation, entertainment, and other activities.

BACKGROUND OF THE INVENTION

It is well known that the center of mass of a person completes vertical motions with each step when the person runs or walks. During each step the person lifts himself up for a few centimeters, spends certain energy, and loses the most portion thereof without return.

The main purpose of a typical footwear-supplementing device, which has an elastic system, is the conservation and returning the kinetic energy to the user and also the reduction of shock loads on the user's leg joints and spine.

The effectiveness of such a device depends on an optimal condition of the energy exchange between the device and the user in locomotion. This optimal condition exists when the inert forces are balanced with the elastic forces, which results in that the energy exchange between the user and the device is most efficient. This is known as a resonance phenomenon. However, the condition of resonance depends on each user's individual characteristics. If this device works well for one user, it does not necessarily mean that the device will work for another user as well. This is a serious disadvantage of such devices.

The instant invention is based on the concept that the design of a footwear-supplementing device has to consider the device itself and the user with his/her individual characteristics as a whole, i.e. as one common system. An individual setup or adjustment of the device needs to be applied to each user.

The known solutions do not usually take into consideration the aforementioned condition of resonance. Typical devices of this kind are taught, for example, in the following U.S. patents:

| | |
|---|---|
| 75,900 | Hale and Hubbell (1868) |
| 871,864 | Feazell and Thompson (1907) |
| 1,587,749 | Bierly (1926) |
| 4,360,978 | Simpkins (1982) |
| 4,534,124 | Schnell (1985) |
| 5,343,636 | Sabol (1994) |

However, the above-mentioned devices are not adjustable for a variety of users with different weight and manner of motion.

There is known a U.S. Pat. No. 6,436,012 issued to Naville (2002). Naville's device has an intermediate section composed of separate non-simple parts in order to adjust the resistance of the intermediate section according to the weight of a user. It however requires the availability of the parts for the intermediate section that increases the cost of the device. Besides, if these parts are metal springs, it will increase the weight of the device. Moreover, Naville's device is not adjustable to the manner of locomotion of a particular user. As a result, the user will have to adapt to the device, which is usually inconvenient. The opposite way is preferred, i.e. the device should be adjusted for the user.

There are also known U.S. Pat. No. 6,283,897 to Patton, U.S. Pat. No. 6,955,616 to Barth, and U.S. Pat. No. 7,736,285 to Brown. The elastic systems taught in those patents are based on elastomeric (e.g. 'means for elastomeric tethering' taught in Barth) or stretchable (e.g. 'a first stretchable member' and 'a second stretchable member' taught in Brown) members having a variable length (that create a resistance during exercises, e.g. 'elastomeric resistance members such as surgical tubings' taught in Patton), whereas the instant invention has no such stretchable members, but instead uses flexible members with a constant length that limit displacement of certain other device members.

Thus the mentioned related art devices have at least two problems:

1. The resonance phenomenon is not considered in the design and operation of the aforesaid devices. Therefore, those devices do not work optimally.
2. Every person has his/her unique condition of resonance. This condition is not addressed in the aforesaid devices.

On the other hand, taking into consideration the resonance condition causes difficulties in the development of a commercially viable footwear-supplementing device.

OBJECTS AND BRIEF SUMMARY OF THE INVENTION

In order to provide comfortable resonant conditions for running or walking, the device must have a capability of adjusting to a particular user.

Therefore, a primary object of the present invention is the designing of a device that can be adjusted by a variety of users according to their bodymass and their unique manner of locomotion, which device should operate in the resonance mode. This provides favorable conditions for an energy exchange between the device and the user in order to move with greater ease and comfort.

Another object of this invention is to provide a method for adjustment of the inventive device. The user's mass (weight), his/her style of movement and pattern of locomotion should be taken into consideration.

Other objects of the invention can be identified by a person skilled in the art upon learning the present disclosure. Without further analysis, the present disclosure will so fully reveal the gist of the invention that others can, by applying current knowledge, readily adapt it for various applications without omitting features that, from the standpoint of prior art, fairly constitutes essential characteristics of the generic or specific aspects of this invention.

There are three styles of movement, respectively, when a person puts his foot down on the ground with a rearfoot, midfoot, or forefoot strike (or load). In most cases, people use the rearfoot style. The pattern of locomotion determines a comfortable length of a person's step and a favorable speed of the person without any device.

It is known that running may include two phases: a phase of support (support phase) when the foot is in contact with the ground, and a transport phase when both the feet are off the ground. When a person walks, there is no transport phase so he/she only has the support phase. The duration of the support phase is very important, because it determines the condition of interaction between the device and the person.

As mentioned above, the user and the footwear-supplementing device jointly create a common elastic system. Any elastic system is characterized by a natural oscillation period (frequency). If the oscillation period of the common elastic system is greater than the duration of the support phase, then the device is unable to transmit all of the energy stored in the system to the user.

If the oscillation period is less than the duration of support phase, then the device is unable to absorb all the energy from the user.

If the oscillation period is essentially equal to the duration of support phase then the device is capable of absorbing and returning the most possible energy from and to the user respectively. In such a case, the energy exchange between the device and the user in locomotion is most efficient.

The condition of resonance is fulfilled when the oscillation period of the joint elastic system of the device and the person is equal to the duration of the support phase that is calculated under the following conditions: the comfortable length of the step and the favorable speed for the person without any device.

This invention provides an adjustable spring device for walking and running that can be coupled to a user's footwear, creating comfortable conditions during the locomotion. In embodiments, it includes: an upper lever and a lower lever locating one above the other, wherein at least one of the levers is made of elastic material, and a support mechanism having a joint shaft that allows the levers to be pivoting. The device includes a first flexible link connecting the front ends of the levers, and a second flexible link connecting the rear ends of the levers. The links can be adjusted to a certain constant length before the deployment of the device. For creating optimal energy exchange conditions between the device and the user, and reducing the shock loads on the user's leg joints and spine, the device can be adapted by shifting the support mechanism between the levers and by adjusting the flexible links between the lever ends.

DETAILED DESCRIPTION OF PREFERRED EMBODIMENTS OF THE INVENTION

While the invention may be susceptible to embodiment in different forms, there are described in detail herein below, specific embodiments of the present invention, with the understanding that the present disclosure is to be considered an exemplification of the principles of the invention, and is not intended to limit the invention to that as illustrated and described herein.

First Embodiment of the Inventive Device

Figure 1:
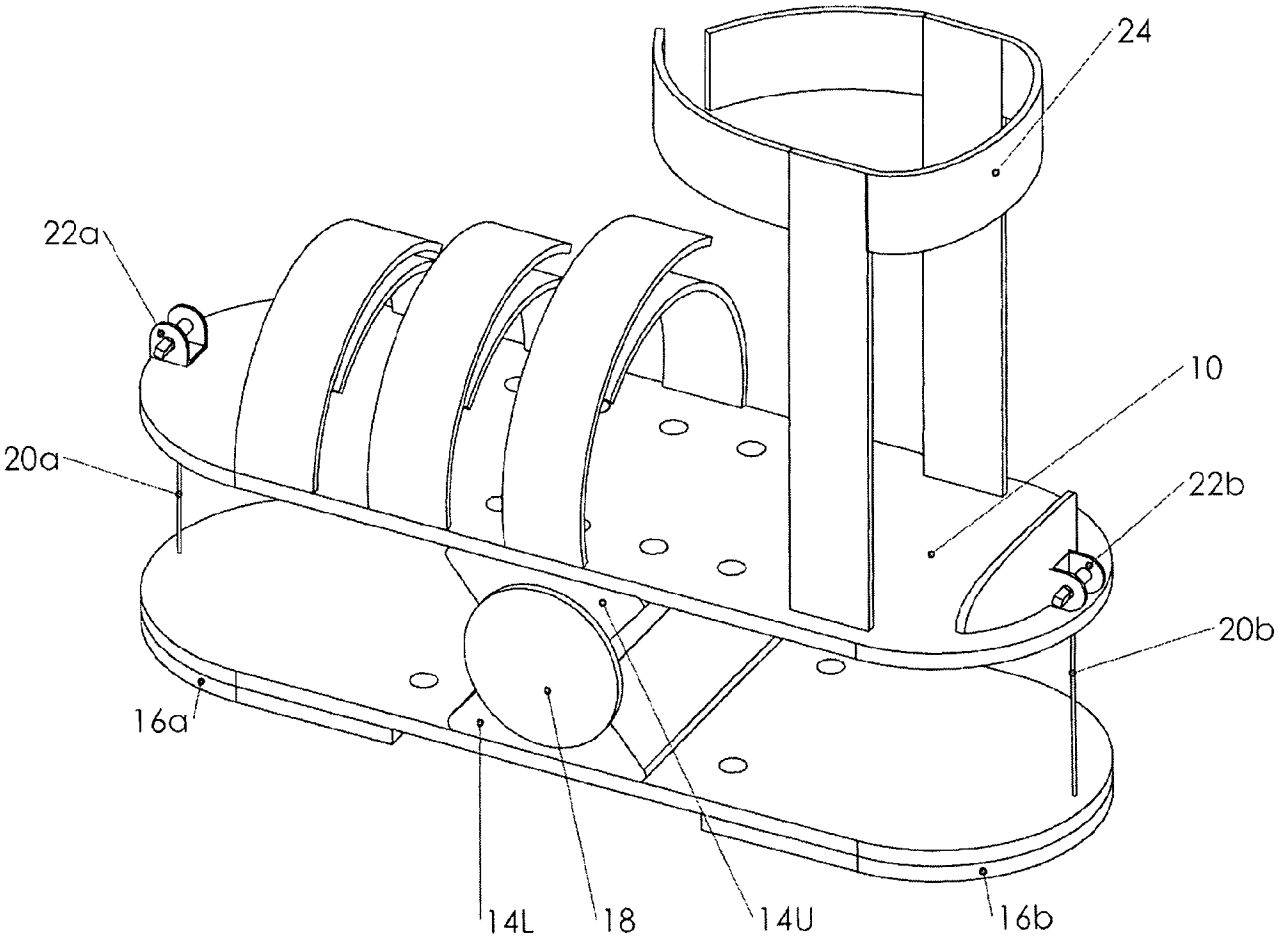
FIG. 1 is a perspective view of the adjustable spring device for walking and running, according to a first embodiment of the present invention.

FIG. 1 shows a perspective view of the first embodiment of the adjustable spring device for walking and running. The device comprises an upper 10 lever and a lower 12 lever located one above the other. One of the levers must be made of elastic material. Levers 10 and 12 can be of various shapes. In this embodiment levers 10 and 12 are configured in the form of plates, having a size approximately equal to the outline of normal footwear. Upper lever 10 has a rear strut 26 providing heal stoppage and support.

Figure 6:
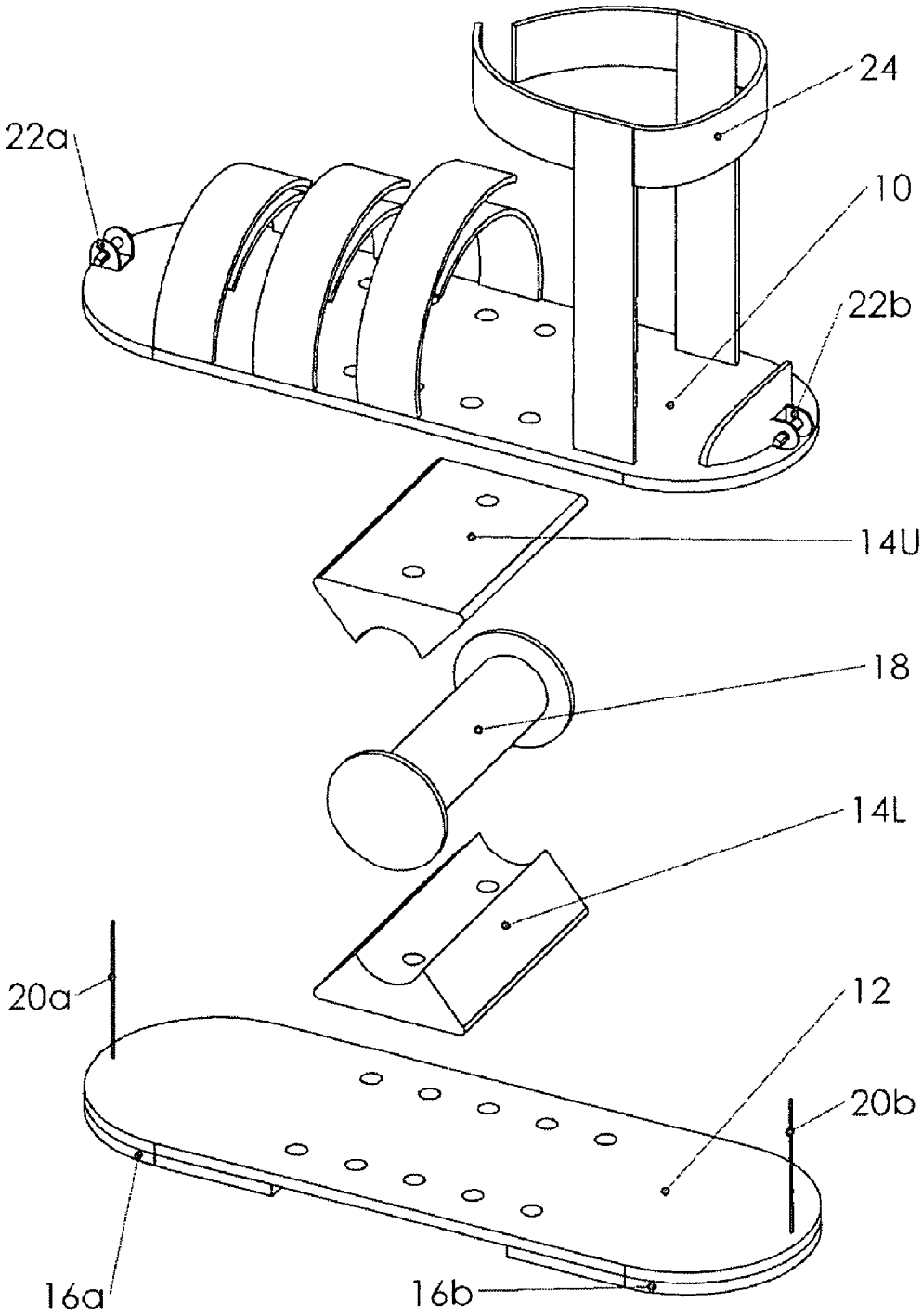
FIG. 6 is a perspective exploded view of the device, according to the first embodiment of the present invention shown in FIG. 1.

In the first embodiment, particularly shown in FIGS. 1 and 6, the inventive device comprises a hinge joint unit that includes a joint shaft 18 and two support lips (also further called 'support units'): an upper lip 14U and a lower lip 14L. The lips 14U and 14L have an inner half-cylindrical shape and, when assembled, form a cylindrical yoke rotatably embracing the shaft 18 that functions as a common fulcrum for levers 10 and 12, wherein shaft 18 allows the levers 10 and 12 to be pivoted in relation to each other. Due to shaft 18, the levers 10 and 12 operate more efficiently by accumulating energy over its entire length during the forefoot load and rearfoot load phases. Lower lever 12 is made preferably wider than upper lever 10 for achieving a lateral stability. Conventional fasten means for fixing the support lips 14U and 14L in different positions (i.e. further or closer to the front end of the levers) between the levers 10 and 12 can be provided, for instance, pins and holes, or screws and threaded holes, or the like.

The ends of levers 10 and 12 are tied with adjustable flexible links 20*a* and 20*b*. A means for adjusting the length and the tension of flexible links 20*a* and 20*b* can be provided by adjustment mechanisms 22*a* and 22*b*, for example, guitar pegs or similar. Since the moment when the lengths of flexible links 20*a* and 20*b* have been adjusted, these lengths are to be constant and the links must be fixed. Therefore, the inventive device should comprise a means for fixing (not illustrated) these pegs in the adjustment mechanisms 22*a* and 22*b*. Adjustment mechanisms 22*a* and 22*b* help the user to set a comfortable angle between upper lever 10 and lower lever 12.

Upper lever 10 is attached to the footwear by means of securing straps 24, made, for instance, of Velcro or the like. A pad 16*a* is attached to the front end of the bottom of lower pad 12, and pad 16*b* is attached to the rear end of the bottom of lower pad 12.

Pads 16*a* and 16*b* are made of material suitable for contact with the ground. Levers 10 and 12 are fabricated from a suitable high-tensile (high-strength) elastic material such as a composite material, e.g. carbon fiber or fiberglass or similar. The flexible links must be made of a material that is not elastic, or non-resilient, such that the length of the flexible links cannot vary after the adjustment is completed. Preferably, aircraft cords or the like can be used for making flexible links 20*a* and 20*b*. Support lips 14U and 14L, and shaft 8 can be fabricated from composite materials, or aluminum alloy, or similar.

During operation, in the support phase, the kinetic energy of the person's body is transformed to the potential energy of bending beams (levers 10 and 12) and then it is reversely transformed into the kinetic energy. Additionally, there appears a torque when levers 10 and 12 are shifted relatively to each other.

Figure 3:
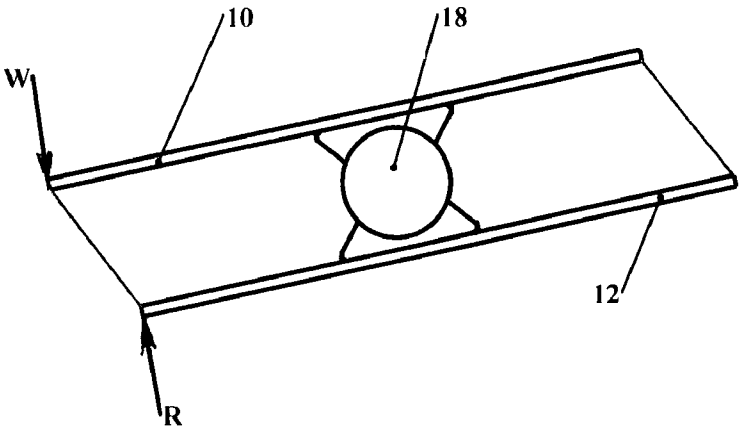
FIG. 3 is a schematic side view of the device in the position of forefoot loading (device loaded by the tip of the foot) when the upper lever is shifted forward relatively to the lower lever, according to the first embodiment of the present invention shown in FIG. 1.
Figure 2:
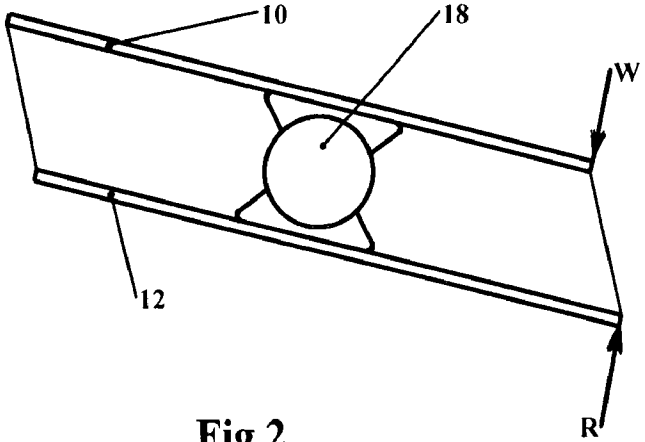
FIG. 2 is a schematic side view of the device in the position of rearfoot loading (device loaded by the heel) when the upper lever is shifted forward relatively to the lower lever, according to the first embodiment of the present invention shown in FIG. 1.

In FIG. 2 and FIG. 3 there is shown a force couple (a weight of the person W and a ground reaction force R), which creates a torque that helps the person moving forward (called an 'aggressive style' of motion).

Figure 5:
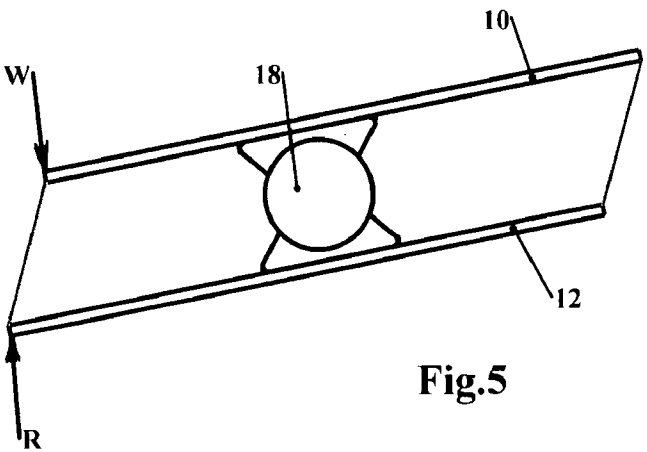
FIG. 5 is a schematic side view of the device in the position of forefoot loading when the upper lever is shifted rearward relatively to the lower lever, according to the first embodiment of the present invention shown in FIG. 1.
Figure 4:
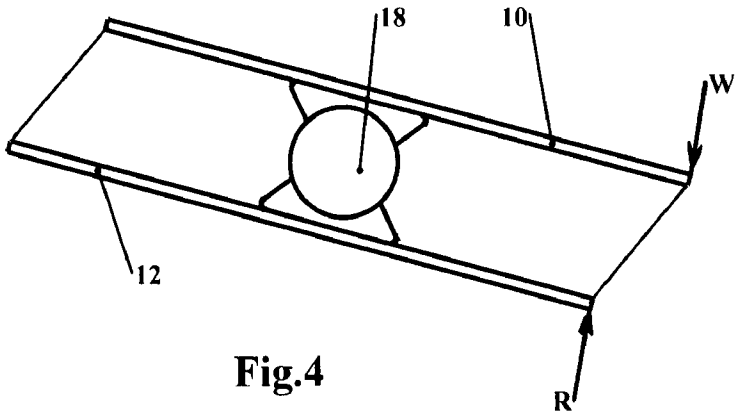
FIG. 4 is a schematic side view of the device in the position of rearfoot loading when the upper lever is shifted rearward relatively to the lower lever, according to the first embodiment of the present invention shown in FIG. 1.

In FIG. 4 and FIG. 5, there is shown a force couple (a weight of the person W and a ground reaction force R) that creates a torque against the movement of the person ('comfortable style'). In this case the torque presses the device up to the foot of the person and the person feels complete control over the device.

Configuring the device is composed of coarse tuning and accurate tuning. The coarse tuning is the selection of a support position between the levers. The coarse tuning determines the period of natural oscillation. The accurate tuning is to adjust the flexible links, which can be shortened or lengthened to deform the elastic lever, so that the user can set an initial amount of force.

Preferred Method for Adjustment of the Inventive Device of First Embodiment

Step 1. Defining a 'comfortable length' of the person's step (the right foot to the left foot) as the traveled distance divided by the number of the person's steps. It is determined by the length of the legs and the angle between the hips. Approximately the length of the step is equal to the length of the person's leg.

Step 2. Defining a favorable speed of movement of the person without any device as the traveled distance divided by the time of movement.

Step 3. Calculating a comfortable foot-ground contact time, based on the ratio of the comfortable length to the favorable speed.

Step 4. Calculating a resonant cyclic frequency of the device. The resonant cyclic frequency is equal to the inverse of the comfortable foot-ground contact time (i.e. being a reciprocated value thereof).

Step 5. Calculating a comfortable stiffness of the device. The comfortable stiffness is equal to the bodymass multiplied by the square of the resonant cyclic frequency.

Step 6. Calculating a static deflection under the load of weight of the person. It is calculated based on the ratio of the weight to the comfortable stiffness.

Step 7. Setting the support lips 14U and 14L at a position between the levers so that the static deflection at the ends of levers 12 and 10 under the load of weight of the person is equal the static deflection calculated on Step 6.

Step 8. Setting an initial value of the force of the elastic lever, which is deformed by shortening or lengthening the adjustable flexible links 20*a* and 20*b*.

Steps 4, 5, and 6 can be combined in one Step, then one should calculate the static deflection, which is equal to 0.25 multiplied by the square of the ratio of comfortable step length to favorable speed.

An example follows: a man's bodymass is m=80 kg, i.e. his weight is 80×9.81=785 N 1) His comfortable step's length is 0.9 m;
2) His favorable speed is 3.2 m/s;
3) Comfortable foot-ground contact time equals 0.9/3.2=0.281 s;
4) Resonant frequency of the device is 1/0.281=3.56 1/s;
5) Comfortable stiffness of the device is: $m\times\omega^2=m\times(2\pi f)^2=80\times(2\times3.14\times3.56)^2=40000$ N/m;
6) Static deflection under the load of his weight is: 785/40000=0.02 m=2 cm;

When Steps 4, 5, and 6 are combined in one Step, then the static deflection is equal to $0.25\times(0.9/3.2)^2=0.02$ m=2 cm;

7) One chooses the position of the support lips 14U and 14L so that the ends of upper level 10 and lower lever 12 have the static deflection mentioned above (2 cm), under the load (rearfoot or forefoot) of his weight.
8) One sets the initial value of the elastic force by mans of adjustable flexible links 20*a* and 20*b*.

The first embodiments of this invention can be used for walking and running by people of all ages and as a simulator for rehabilitation after injury. It can also be used as shoe soles. The method of calculation of comfortable stiffness can be used in the development of elastic systems for walking and running.

Second Embodiment of the Inventive Device

Figure 7:
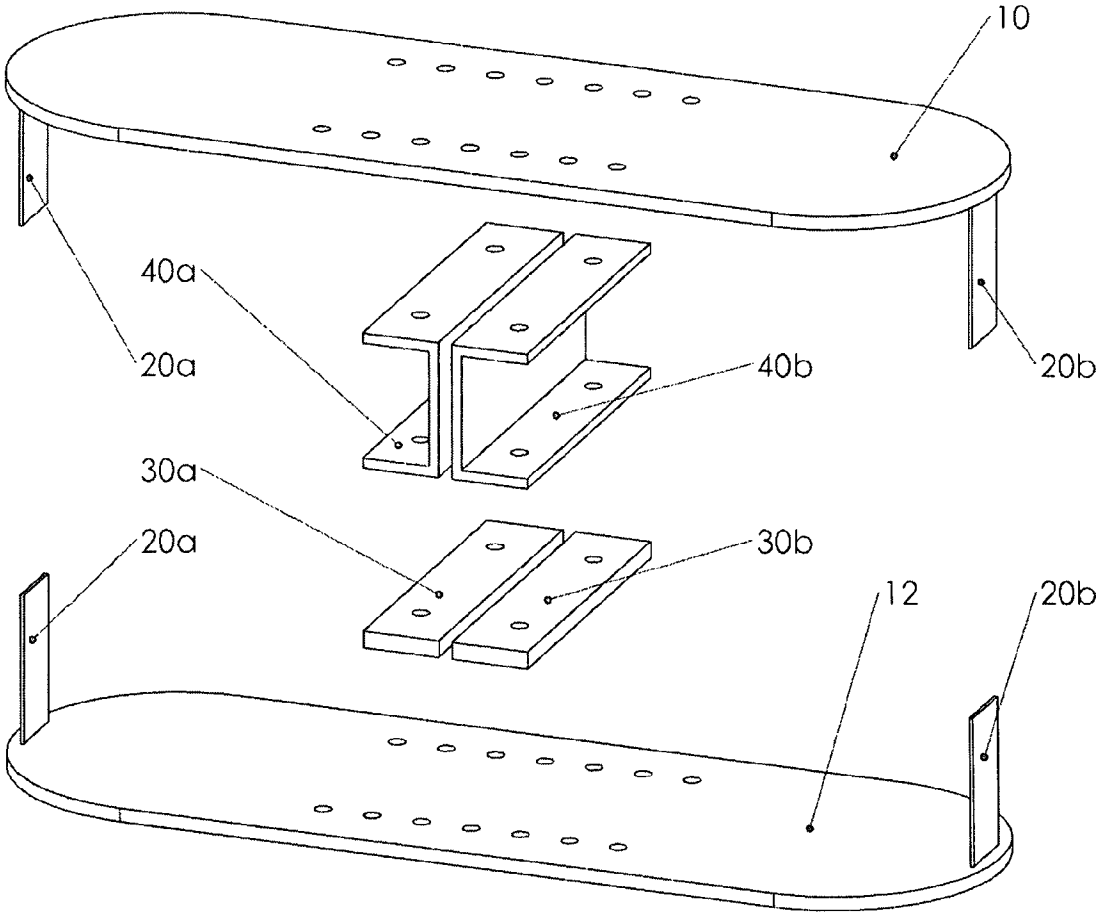
FIG. 7 is a perspective exploded view of the device, according to a second embodiment of the present invention.
Figure 8:
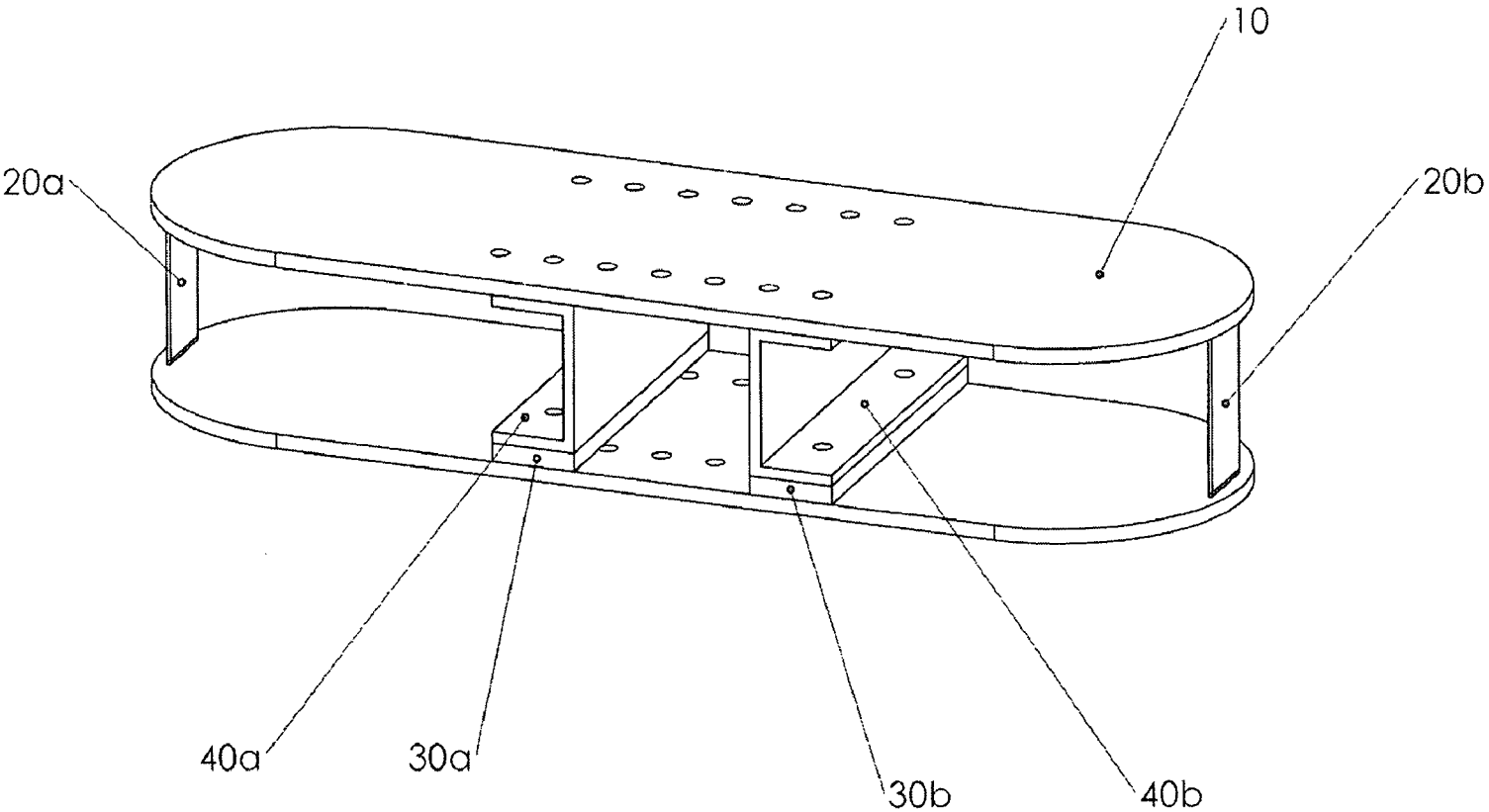
FIG. 8 is a perspective view of the assembled device having a wider support surface, according to the second embodiment of the present invention shown in FIG. 7.
Figure 9:
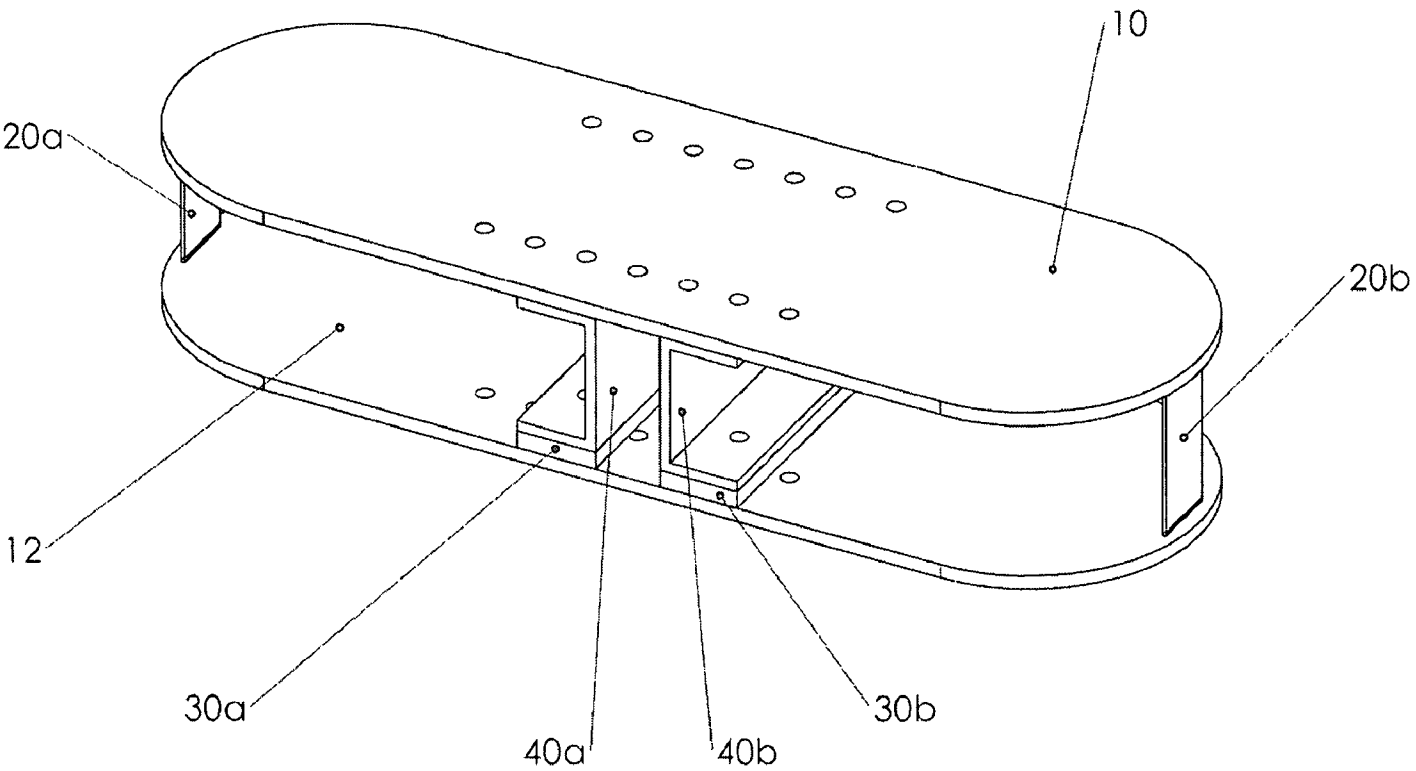
FIG. 9 is a perspective view of the assembled device having a narrower support surface, according to the second embodiment of the present invention shown in FIG. 7.

In a second embodiment shown in FIGS. 7-9, the inventive device comprises: an upper lever 10 attached to the user's footwear; and a lower lever 12 mounted under the lever 10; two support brackets 40*a* and 40*b* attached to upper lever 10, and through elastic gaskets 30*a* and 30*b* attached to lower lever 12. Suitable conventional fasten means can be utilized for attachment of the support brackets to the levers, such as pins, screws, etc. The ends of levers 10 and 12 are tied with adjustable flexible links 20*a* and 20*b*. Means for adjusting (not illustrated for the second embodiment) the length and the tension of flexible links 20*a* and 20*b* can be provided similar to adjustment mechanisms 22*a* and 22*b* of the first embodiment described above, wherein the lengths of flexible links 20*a* and 20*b* must be kept constant after the adjustment is completed.

The support brackets 40*a* and 40*b* are used to adjust the device to the user by shifting the support brackets into different positions along levers 10 and 12. The stiffness of the device increases when support brackets 40*a* and 40*b* are moved apart to the ends of levers 10 and 12 (as shown in FIG. 8); and, vice versa, the stiffness decreases when support brackets 40*a* and 40*b* are shifted to the center of levers 10 and 12 (as shown in FIG. 9). The lengths of flexible links 20*a* and 20*b* must be constant after the adjustment is completed. When the stiffness of the device is changed, its natural frequency changes as well that, in turn, changes the resonance duration of the support phase. The elastic gaskets 30*a* and 30*b* allow for deformation of lower lever 12 while maintaining the integrity of the device.

Third Embodiment of the Inventive Device

Figure 10:
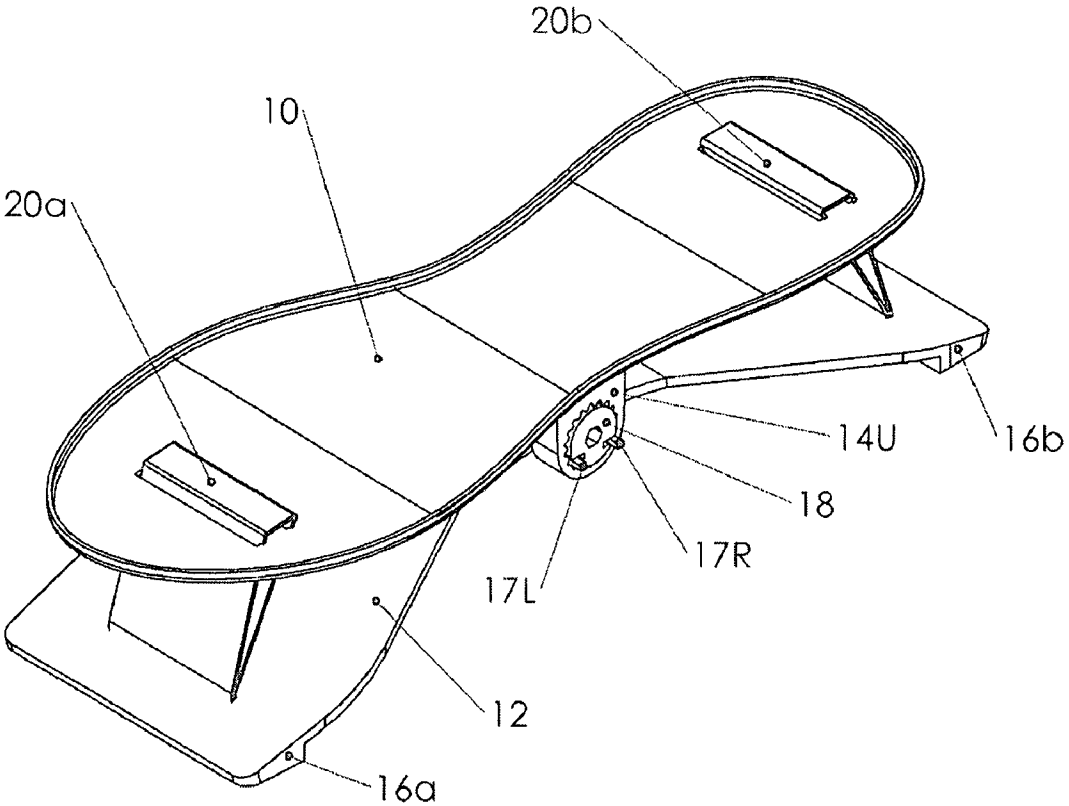
FIG. 10 is a perspective view of the device, according to a third embodiment of the present invention.
Figure 11:
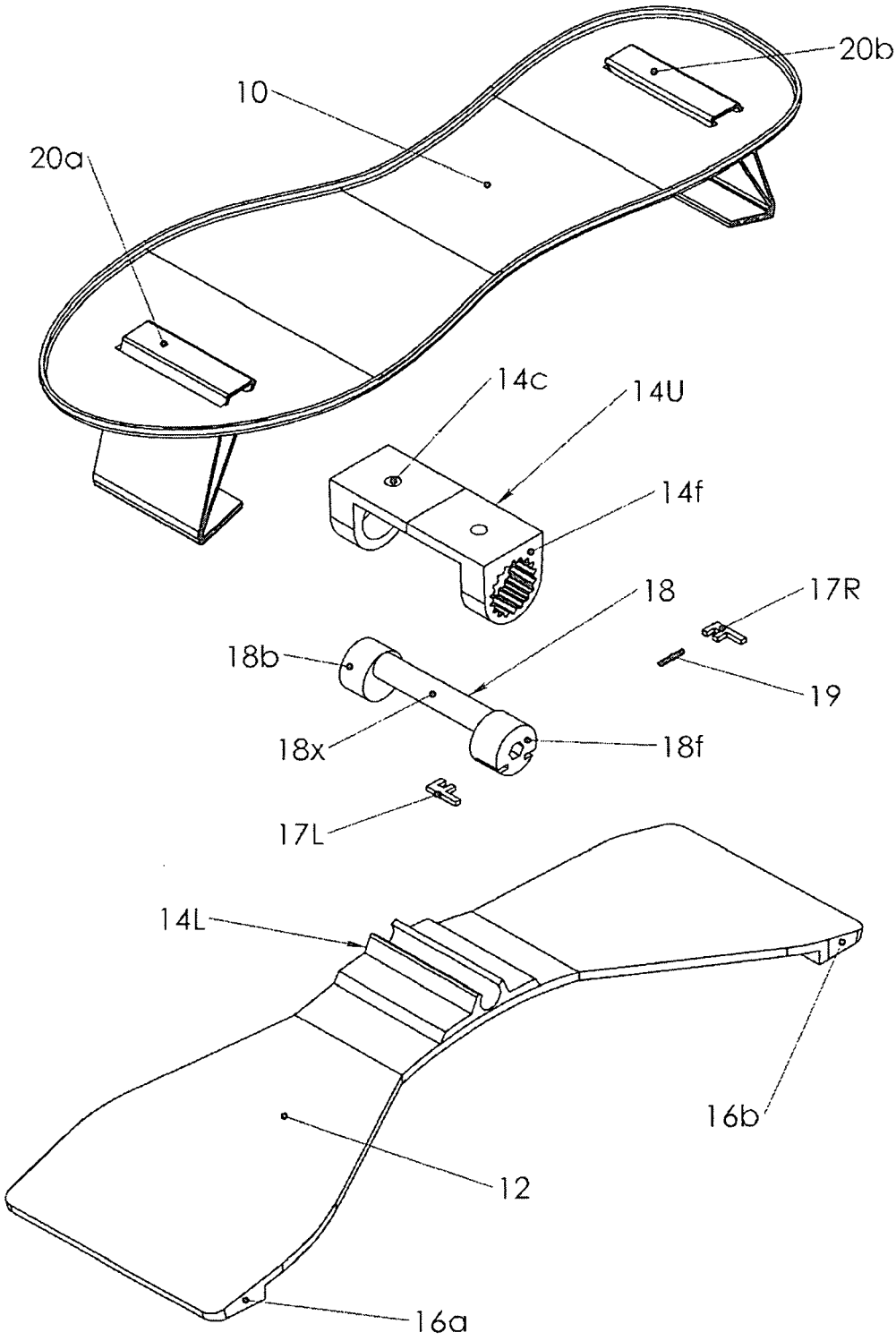
FIG. 11 is an exploded view of the device, according to the third embodiment of the present invention shown in FIG. 10.

In a third embodiment shown in FIGS. 10-11, the inventive device comprises: an upper 10 lever attached to the user's footwear, and a lower lever 12 located under the upper lever 10; an upper support unit 14U, and a lower support unit 14L. Similarly to the first embodiment, a pad 16*a* is attached to the front end of the bottom of lower pad 12, and pad 16*b* is attached to the rear end of the bottom of lower pad 12.

The upper support unit 14U includes: a flat plate with conventional coupling means 14*c* used for fastening the plate to upper lever 10, the flat plate has a front end and a back end; a front cage 14*f* coupled with the plate at the front end, the front cage 14*f* has a cylinder inner surface with teeth arranged thereon; a back cage 14*b* coupled with the plate at the back end, the back cage 14*b* has a cylinder inner surface.

The inventive device also comprises: a joint shaft (fulcrum) 18 having an eccentric shape of a crankshaft. Shaft 18 includes: a back cylindrical head 18*b*; a front cylindrical head 18*f* having two longitudinal slots oppositely arranged on the lateral surface thereof, wherein front head 18*f* has a transversal hole connecting the two slots; a spring 19 is preloaded and inserted into the transversal hole; two F-shaped detents 17L and 17R being inserted into the slots such that spring 19 depresses detents 17L and 17R outwardly; and an axle 18*x* located between back head 18*b* and front head 18*f* and coupled thereto. Axle 18*x* has a longitudinal axis, which is offset in relation to the centers of back head 18*b* and front head 18*f*. Back head 18*b* is enclosed into back cage 14*b*; front head 18*f* is enclosed into front cage 14*f*, such that detents 17L and 17R are inserted into the corresponding two teeth of the inner surface of front cage 14*f* thereby allowing for changing angular positions of axle 18x by inwardly depressing detents 17L and 17R, for instance with user's fingers or any specific tool embracing the protruded portions of the F-shaped detents 17L and 17R.

The lower support unit 14L is coupled to lower lever 12, and has a bedding with an inner half-cylindrical shape. When assembled with shaft 18, the axle 18 is pivotally enclosed in the bedding of lower support unit 14L, which allows the lower lever 12 to be pivoted in relation to the upper lever 10. Due to the crankshaft shape of shaft 18 and its capability to be pivoted inside of the lower support unit 14L, the levers 10 and 12 are moved further or closer to each other. Fixing the shaft 18 in different positions relative to the lower support unit 14L is provided by engaging the detents 17L and 17R with the corresponding inner teeth of front cage 14*f*, the spring 19 pushes detents 17L, 17R into the teeth. As a result, the levers 10 and 12 are fixed in relation to each other.

The ends of upper lever 10 and lower lever 12 are tied with flexible (but not elastic) links 20*a* and 20*b*. The mounting of links 20*a* and 20*b* is provided when shaft 18 is set in its upper position, and there is a minimum distance between the levers 10 and 12. This enables achieving a minimum bending of the levers 10 and 12, which corresponds to the resonance duration of the support phase being maximal.

After setting up the lengths of flexible links 20*a* and 20*b*, the lengths are to be constant and the links must be fixed. When the shaft 18 is pivoted, the fulcrum point shifts down the lower lever 12 by bending thereof. When the fulcrum point is in the bottom position, the distance between levers 10 and 12 is maximal, i.e. the bending is maximal as well, and therefore the resonance duration of the support phase is minimal. The users can easily adjust the inventive device by pivoting the shaft 18, when the inner teeth are free from detents 17L and 17R by shortening the spring 19.

The following table shows values of the resonance stiffness of the device for certain values of the bodymass and the duration of support phase.

| | | Resonance stiffness, N/m | | | | | |
|---|---|---|---|---|---|---|---|
| | | Bodymass, Kg | | | | | |
| | | 50 | 60 | 70 | 80 | 90 | 100 |
| the | 0.600 | 5500 | 6600 | 7700 | 8800 | 9900 | 11000 |
| phase | 0.500 | 7900 | 9500 | 11000 | 12600 | 14200 | 15800 |
| of | 0.400 | 12300 | 14800 | 17300 | 19700 | 22200 | 24600 |
| | 0.300 | 21900 | 26300 | 30700 | 35100 | 39400 | 43800 |
| | 0.200 | 49300 | 59200 | 69000 | 78900 | 88700 | 98600 |
| | 0.150 | 87600 | 105200 | 122700 | 140200 | 157800 | 175300 |

Therefore, the resonance stiffness is changed from 5500 to 180000 N/m. This interval is covered by the inventive device.

I claim:

1. An adjustable spring device for walking and running for a user, comprising:

(a) an upper lever and a lower lever having a predetermined shape; said lower level is mounted below said upper lever, and at least one of said levers is made of elastic material, each said lever has a front end and a rear end, said upper lever is attached to the user's footwear;

(b) means for support of said levers, said means for support join said levers and function as a common fulcrum for said levers;

(c) means for setting the means for support in different positions between said levers;

(d) a first flexible link connecting the front ends of said levers and a second flexible link connecting the rear ends of said levers, said flexible links each has a respective length; and (e) means for adjusting the length of at least one of said flexible links;

wherein the setting of said means for support in different positions between said levers allows for adjustment of the tension of said flexible links, thereby adjusting the spring device according to a particular style and a pattern of locomotion of the user.

2. The device as defined in claim 1 wherein said predetermined shape of levers is represented in the form of plates with an outline of normal footwear.

3. The device according to claim 1, wherein said means for adjusting the length of at least one of the flexible links are represented in the form of guitar pegs.

4. The device according to claim 1, wherein said different positions between said levers are so chosen that said upper lever has a predetermined shift forward or backward relatively to the lower lever for creating an additional torque during user's locomotion.

5. The device according to claim 1, wherein said lower lever is predeterminedly wider than said upper lever for achieving a lateral stability.

6. The device according to claim 1, wherein said means for support of the levers are set at a position between said levers so that the static deflection at the ends of said levers under the weight of the user is equal to 0.25 multiplied by a squared ratio of a predetermined comfortable step length of the user divided by a predetermined favorable speed of the user without any device.

7. A method of adjusting said spring device defined in claim 1 to the user so that the oscillation period of an elastic system formed by said spring device with the user is equal to the duration of support phase of the user's foot on the ground without any device.

8. The method of claim 7, further including the steps of:

(A) defining a comfortable length of the user's step without any device is the traveled distance divided by the number of steps;

(B) defining a favorable speed of the user without any device is the traveled distance divided by a time of the user's moving;

(C) providing the device according to claim 1;

(D) setting the means for support of said levers at a position between the levers so that the static deflection at the ends of said levers under the weight of the user is equal to 0.25 multiplied by a squared ratio of a predetermined comfortable step length of the user divided by a predetermined favorable speed of the user without any device; and (E) setting an initial value of elastic force by adjusting the tension of the flexible links by using said means for setting the means for support in different positions between said levers;

thereby providing the oscillation period of said elastic system to be equal to the duration of the support phase to create comfortable conditions for the user's walking and running.

9. An adjustable spring device for walking and running for a user, comprising:

an upper lever and a lower lever; said lower level is mounted below said upper lever, and at least one of said levers is made of elastic material, each said lever has a front end and a rear end, said upper lever is attached to the user's footwear;

a first flexible link connecting the front ends of said levers and a second flexible link connecting the rear ends of said levers, said flexible links each has a respective length;

means for adjusting the length of at least one of said flexible links, wherein the lengths of said flexible links are kept constant after the adjustment is completed; and two support brackets attached to said upper lever, and attached through elastic gaskets to said lower lever, said support brackets are capable of shifting along said levers closer or further to the ends of said levers, thereby adjusting the spring device according to a particular style and a pattern of locomotion of the user.

10. An adjustable spring device for walking and running for a user, comprising:

an upper lever and a lower lever; said lower level is mounted below said upper lever, wherein at least one of said levers is made of elastic material, each said lever has a front end and a rear end, said upper lever is attached to the user's footwear;

a first flexible link connecting the front ends of said levers and a second flexible link connecting the rear ends of said levers, said flexible links each has a respective length;

means for adjusting the length of at least one of said flexible links, wherein the lengths of said flexible links keep constant after the adjustment is completed;

an upper support unit including a flat plate coupled to said upper lever, the flat plate has a front end and a back end; a front cage coupled with the plate at the front end, the front cage has a cylinder inner surface with teeth arranged thereon; a back cage coupled with the plate at the back end, the back cage has a cylinder inner surface;

a lower support unit coupled to said lower lever, the lower support unit has a bedding with an inner half-cylindrical shape;

a joint shaft having an eccentric shape of a crankshaft, said joint shaft includes:

a back cylindrical head pivotally enclosed into said back cage, when the device is assembled, a front cylindrical head having two longitudinal slots oppositely arranged on the lateral surface thereof, wherein said front head has a transversal hole connecting said two slots, said front head is pivotally enclosed into said front cage, when the device is assembled, a spring preloaded and inserted into the transversal hole, an axle located between said back head and said front head and coupled thereto, said axle has a longitudinal axis offset in relation to the centers of said back head and said front head, said axle is pivotally enclosed into said bedding when the device is assembled, and two F-shaped detents being inserted into said slots such that said spring depresses said detents outwardly that allows for changing angular positions of said joint shaft in relation to said levers, thereby adjusting the spring device according to a particular style and a pattern of locomotion of the user.

* * * * *